US006567621B2

(12) United States Patent
Miyoshi et al.

(10) Patent No.: US 6,567,621 B2
(45) Date of Patent: May 20, 2003

(54) TANDEM PRINTERS SYSTEM

(75) Inventors: Takahiro Miyoshi, Kawasaki (JP); Shinichi Takahashi, Kawasaki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/026,443

(22) Filed: Dec. 27, 2001

(65) Prior Publication Data

US 2003/0026619 A1 Feb. 6, 2003

(30) Foreign Application Priority Data

Aug. 3, 2001 (JP) ..... 2001-236515

(51) Int. Cl.[7] ..... G03G 15/00
(52) U.S. Cl. ..... 399/19; 399/21; 399/384
(58) Field of Search ..... 399/6, 16, 18, 399/19, 21, 194, 306, 384

(56) References Cited

U.S. PATENT DOCUMENTS 4,299,477 A * 11/1981 Ward et al. ..... 399/19
5,107,299 A * 4/1992 Farrell et al. ..... 399/19
5,413,419 A 5/1995 Oami et al.
5,664,074 A 9/1997 Kageyama et al.
5,701,565 A * 12/1997 Morgan ..... 399/384 X
5,829,707 A * 11/1998 Lamothe ..... 399/384 X
5,963,770 A * 10/1999 Eakin ..... 399/16 X
6,006,012 A 12/1999 Shimizu
6,297,886 B1 * 10/2001 Cornell ..... 399/384 X

FOREIGN PATENT DOCUMENTS

| | | |
|---|---|---|
| JP | 60-245576 | 12/1985 |
| JP | 5-254185 | 10/1993 |
| JP | 5-301429 | 11/1993 |
| JP | 9-6074 | 1/1997 |

* cited by examiner

*Primary Examiner*—Sandra Brase
(74) *Attorney, Agent, or Firm*—Armstrong, Westerman & Hattori, LLP

(57) ABSTRACT

When a jam happens at the second printer in a tandem printer system, the printing operation is terminated at the first and second printers. The continuous sheet after establishment of the primary page images at the first printer is reserved between the first and second printers. The first recovery page for the second printer is determined based on the primary page images on the continuous sheet remaining between the first and second printers. Accordingly, it is not necessary to remove the entire continuous sheet remaining between the first and second printers when the printing operation should be recovered. It is possible to minimize the loss of the continuous sheet reserved between first and second printers even when a jam happens at the second printer.

8 Claims, 8 Drawing Sheets

TANDEM PRINTERS SYSTEM

BACKGROUND OF THE INVENTION

1. Field of the Invention

The present invention relates to a tandem printers system including a first printer capable of printing primary page images on a continuous sheet and a second printer capable of printing secondary page images, related to the corresponding printed primary page images, on page sections regulated by the printed primary page images on the continuous sheet.

2. Description of the Prior Art

In general, a tandem printers system is utilized to realize a high-speed duplex printing as well as a high-speed spot color printing on a continuous sheet such as continuous forms. In the case of the duplex printing, for example, a first printer such as a high-speed page printer is designed to print front side page images on the front surface of continuous forms. After the front side page images have been printed, the continuous forms are transferred to a second printer such as another high-speed page printer. The second printer is designed to print reverse side page images on the reverse surface of the continuous forms.

When a jam takes place at the second printer in the tandem printers system, the first and second printers stop the printing operation. The first printer then returns to the printing operation. The first recovery page of the first printer is determined based on the reverse side page image printed last at the second printer. For example, if a jam happens at the second printer during the printing operation of the reverse side page image on the fifteenth (15th) page sections on the reverse surface of the continuous forms, the first printer recovers the printing operation for the front side page image corresponding to the fifteenth (15th) page sections on the front surface of the continuous forms.

The tandem printers system is usually designed to reserve the continuous forms, corresponding to a series of a large number of forms or page sections, between the first and second printers. The reserved continuous forms may contain a series of twenty (20) forms or so. For example, when the second printer is printing the reverse side page image of the fifteenth (15th) page section in the aforementioned manner, the first printer may be printing the front side page image of the thirty-fifth (35th) page section. If a jam takes place at the second printer in this situation, the first printer is expected to return to the printing operation for the front side page image of the fifteenth (15th) page section. The reserved continuous forms with the printed front side page images between the first and second printers is simply torn off and destroyed.

SUMMARY OF THE INVENTION

It is accordingly an object of the present invention to provide a tandem printers system capable of minimizing the loss of a continuous sheet reserved between first and second printers even when a jam happens at the second printer.

According to a first aspect of the present invention, there is provided a tandem printers system comprising: a first printer printing primary page images on a continuous sheet; a second printer printing secondary page images, related to the primary page images, on page sections regulated by the primary page images on the continuous sheet; and a controller determining a first recovery page for the second printer based on a printed page at the first printer when at least one of the page sections is removed from the continuous sheet before establishment of the secondary page images.

The tandem printers system serves to print primary and secondary page images on the front and back surfaces of the continuous sheet, respectively. Duplex printing is thus accomplished on the continuous sheet. Otherwise, the tandem printers system serves to sequentially print the primary and secondary page images on the common front surface of the continuous sheet. So-called spot color printing can thus be realized on the continuous sheet. When a jam happens at the second printer, at least one of the page sections is removed from the continuous sheet before establishment of the secondary page images. The first recovery page for the second printer after the removal of the page section can be determined based on the printed page at the first printer. The printed page of the first printer is expected to exist on the continuous sheet reserved between the first and second printers, for example. Accordingly, it is not necessary to remove the entire continuous sheet remaining between the first and second printers when the printing operation should be recovered. It is possible to minimize the loss of the continuous sheet reserved between first and second printers even when a jam happens at the second printer. The controller may be incorporated within any of the first and second printers, or within a separate controller apparatus connected to the first and second printers.

The controller is preferably designed to determine the missing page for the second printer based on the first recovery page and the last printed page at the second printer. Determination of the missing page in this manner leads to a reliable establishment of the primary and secondary page images on the continuous sheet based on the determined missing page.

Upon the establishment of the secondary page image, printing data of the secondary page image corresponding to the missing page may be stored in a storage medium when the jam happens at the second printer. The second printer may simply be designed to read out the printing data of the secondary page image from the storage medium when printing the secondary page image. In addition, printing data of the primary page image related to the missing page for the second printer may also be stored in the storage medium. The first printer may simply be designed to read out the printing data of the primary page image from the storage medium when printing the primary page image. The storage medium may be a magnetic recording disk such as one incorporated within a hard disk drive (HDD) or a diskette drive, a volatile or non-volatile memory, or the like.

In the tandem printers system, the first recovery page for the first printer may be determined based on the last printed page for the first printer. Specifically, the first recovery page of the first printer can be determined irrespective of the last printed page of the second printer. The primary page images can be printed on the continuous sheet in a predetermined sequence or schedule, without any change or skip, in the first printer. The control of the first printer can be facilitated.

Here, the first printer may continue printing the primary page image for a predetermined number of page when a jam happens at the second printer. The continuation of the printing in this manner leads to reserve of the enough continuous sheet between the first and second printers even when the continuous sheet is pulled into the second printer prior to the recovery of the printing operation.

According to a second aspect of the present invention, there is provided a tandem printers system comprising: a first printer printing primary page images on a continuous sheet; a second printer printing secondary page images, related to the primary page images, on page sections regulated by the primary page images on the continuous sheet; and a controller determining a first recovery page for the first printer based on a last printed page at the first printer when a jam happens at the second printer.

The tandem printers system serves to print primary and secondary page images on the front and back surfaces of the continuous sheet, respectively. Duplex printing is thus accomplished on the continuous sheet. Otherwise, the tandem printers system serves to sequentially print the primary and secondary page images on the common front surface of the continuous sheet. So-called spot color printing can thus be realized on the continuous sheet. When a jam happens at the second printer, at least one of the page sections is removed from the continuous sheet before establishment of the secondary page images. The first recovery page for the first printer after the removal of the page section can be determined based on the last printed page at the first printer. The primary page images can be printed on the continuous sheet in a predetermined sequence or schedule, without any change or skip, in the first printer. The control of the first printer can be facilitated.

It should be noted that the first and second printers may take any form such as page printers, dot matrix printers, ink jet printers, copying machines, facsimile machines, or the like.

BRIEF DESCRIPTION OF THE DRAWINGS

The above and other objects, features and advantages of the present invention will become apparent from the following description of the preferred embodiment in conjunction with the accompanying drawings, wherein.

DESCRIPTION OF THE PREFERRED EMBODIMENT

Figure 1:
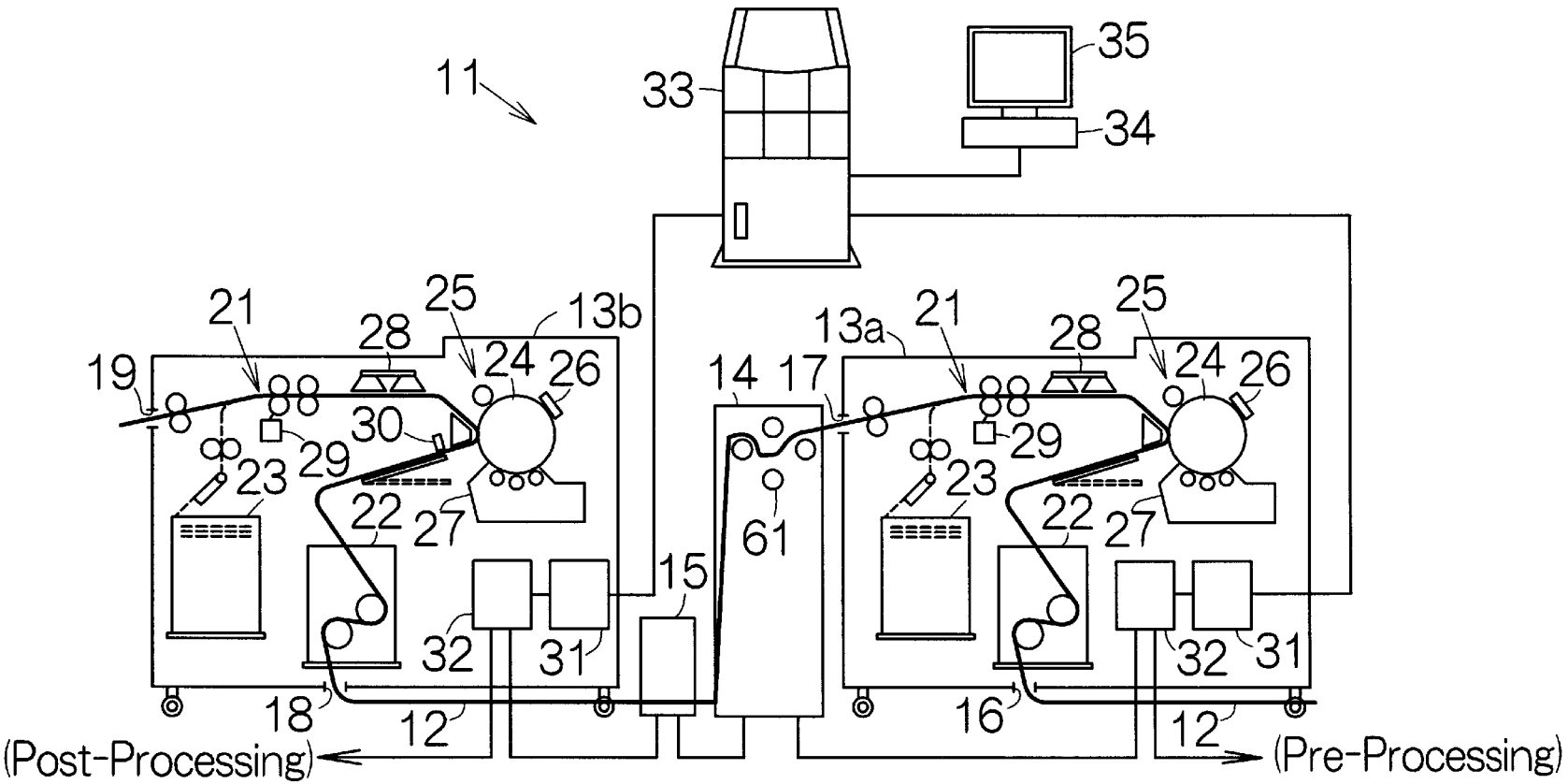
FIG. 1 is a schematic view illustrating the overall structure of a tandem printers system according to a specific example.

FIG. 1 schematically illustrates the entire structure of a tandem or serially connected printers system 11. The tandem printers system 11 includes a first page printer 13*a* first receiving a continuous sheet of paper or continuous forms 12, and a second page printer 13*b* receiving the continuous forms 12 from the first page printer 13*a*. An intermediate buffer device 14 and a reversing mechanism device 15 are disposed between the first and second page printers 13*a*, 13*b*. The intermediate buffer device 14 is designed to temporarily reserve the continuous forms 12, corresponding to a predetermined number of forms or page sections, between the first and second page printers 13*a*, 13*b*. The intermediate buffer device 14 serves to absorb the difference in the printing speed between the first and second page printers 13*a*, 13*b*. The reversing mechanism device 15 is designed to reverse the continuous forms 12 discharged from the intermediate buffer device 14. The tandem printers system 11 realizes a high-speed duplex printing for the continuous forms 12 sequentially passing through the first and second page printers 13*a*, 13*b*. The continuous forms 12 may take the form of roll, stack, or else.

The first page printer 13*a* has an input slot 16 for receiving the continuous forms 12 from a pre-processing apparatus, not shown, such as a web supplier, a hand splicer, and the like, for example. The first page printer 13*a* is designed to sequentially print primary page images or front side page images on the front surface of the continuous forms 12. When the front side page images have been printed on the continuous forms 12, page sections corresponding to single forms or pages can be defined on the front and reverse surfaces of the continuous forms 12. The continuous forms 12 after printing is discharged out of a discharged slot 17 of the first page printer 13*a*. The discharged continuous forms 12 are then transferred to the intermediate buffer device 14.

The second page printer 13*b* has an input slot 18 for receiving the continuous forms 12 from the reversing mechanism device 15. The second page printer 13*b* is designed to print secondary page images or reverse side page images, related to the respective printed front side page images, on the corresponding page sections over the reverse surface of the continuous forms 12. The printing of the reverse side page images leads to establishment of a duplex printing for the individual sheets or forms included in the continuous forms 12. The continuous forms 12 after printing is discharged out of a discharge slot 19 of the second page printer 13*b*. The discharged continuous forms 12 are then transferred to a post-processing apparatus, not shown, such as a web winder, a burster, a job cutter, and the like, for example.

A transporting unit 21 is incorporated in the respective first and second page printers 13*a*, 13*b* so as to establish a transfer path of the continuous forms 12 extending from the input slot 16, 18 to the discharge slot 17, 19. As is apparent from FIG. 1, the transporting unit 21 is designed to transport the continuous forms 12 received from a hopper 22 to the discharge slot 17, 19. Alternatively, the transporting unit 21 may be designed to transport the continuous forms 12 to a stacker 23 within the respective first and second page printers 13*a*, 13*b*.

An imaging unit 25 including an imaging or optical photoconductive drum 24 rotatable around the central axis is located on the transfer path of the continuous forms 12 in the respective first and second page printer 13*a*, 13*b*. An electrostatic image is established on the cylindrical surface of the optical photoconductive drum 24 based on beams from lines of LEDs (Light-Emitting Diode) 26, for example. Toner is then supplied to the cylindrical surface of the optical photoconductive drum 24 from a toner cartridge 27.

The toner serves to visualize the electrostatic image. The visible image of the toner is thereafter transferred to the continuous forms 12.

A fusing unit 28 is disposed between the imaging unit 25 and the discharge slot 17, 19. The fusing unit 28 includes lamps for flashlight utilized to fuse the toner on the continuous forms 12, for example. The heat of the flashlight serves to fuse the particles of the toner sticking to the continuous forms 12. The visible image of the toner is thus deposited on the continuous forms 12.

A page counter sensor 29 is coupled to the transporting unit 21 at a stacker feeder section located between the fusing unit 28 and the discharge slot 17, 19, for example. The page counter sensor 29 is designed to detect the feed amount of the continuous forms 12, for example, based on the rotation amount or angle of feed rollers contacting the continuous forms 12. The last printed page of the front side page image as well as the last printed page of the reverse side page image can be determined at the first and second page printers 13*a,* 13*b,* respectively, based on the detected feed amount.

An image sensor 30 is disposed between the imaging unit 25 and the hopper 22 in the second page printer 13*b,* for example. The image sensor 30 is designed to detect the entirety or part of the front side page images established at the first page printer 13*a*. Based on the signals from the image sensor 30, page sections can be determined on the reverse surface of the continuous forms 12, as described later.

A printer controller 31 and a mechanical controller 32 are incorporated within the respective first and second page printers 13*a,* 13*b*. The printer controller 31 is designed to control the overall printing operation of the respective first and second page printers 13*a,* 13*b*. The printer controller 31 is capable of generating bit map data for individual pages based on printing data received from upper devices such as global servers, main frames, or the like. The mechanical controller 32 is designed to generally control the mechanical systems including the action of the transporting unit 21 as well as the rotation of the optical photoconductive drum 24. The mechanical controller 32 is capable of controlling the transporting speed of the transporting unit 21, the rotational speed of the optical photoconductive drum 24, the operation of the LEDs 26, and the like. The mechanical controller 32 serves to synchronize the operation of the LEDs 26 with the transporting or feeding speed of the continuous forms 12.

A controller apparatus 33 is connected to the first and second page printers 13*a,* 13*b*. A high speed interface channel of the ultra-SCSI standard may be employed to establish the connection, for example. The controller apparatus 33 is designed to generate printing jobs for the first and second page printers 13*a,* 13*b*.

A manipulating terminal 34 such as a personal computer is connected to the controller apparatus 33. The manipulating terminal 34 provides a user interface for the controller apparatus 33 when printing jobs are to be generated at the controller apparatus 33. The user interface may be established based on the implementation of a computer software. The user interface is designed to display text and graphics for the manipulation on the screen of a display 35 of the manipulating terminal 34, for example. The user or operator is allowed to manipulate an input device, not shown, such as a keyboard and a mouse, based on the displayed text and graphics, thereby inputting instructions to the controller apparatus 33. The controller apparatus 33 is notified of the content of the input instructions in this way. Here, the combination of the controller apparatus 33 and the manipulating terminal 34 may be replaced with a single computer terminal. In addition, an upper apparatus such as a host computer as well as a personal computer, not shown, is connected to the controller apparatus 33 for supplying data for printing. A local area network (LAN) may be employed to establish the connection, for example. The host computer may be a global server, a main frame, and the like.

Figure 2:
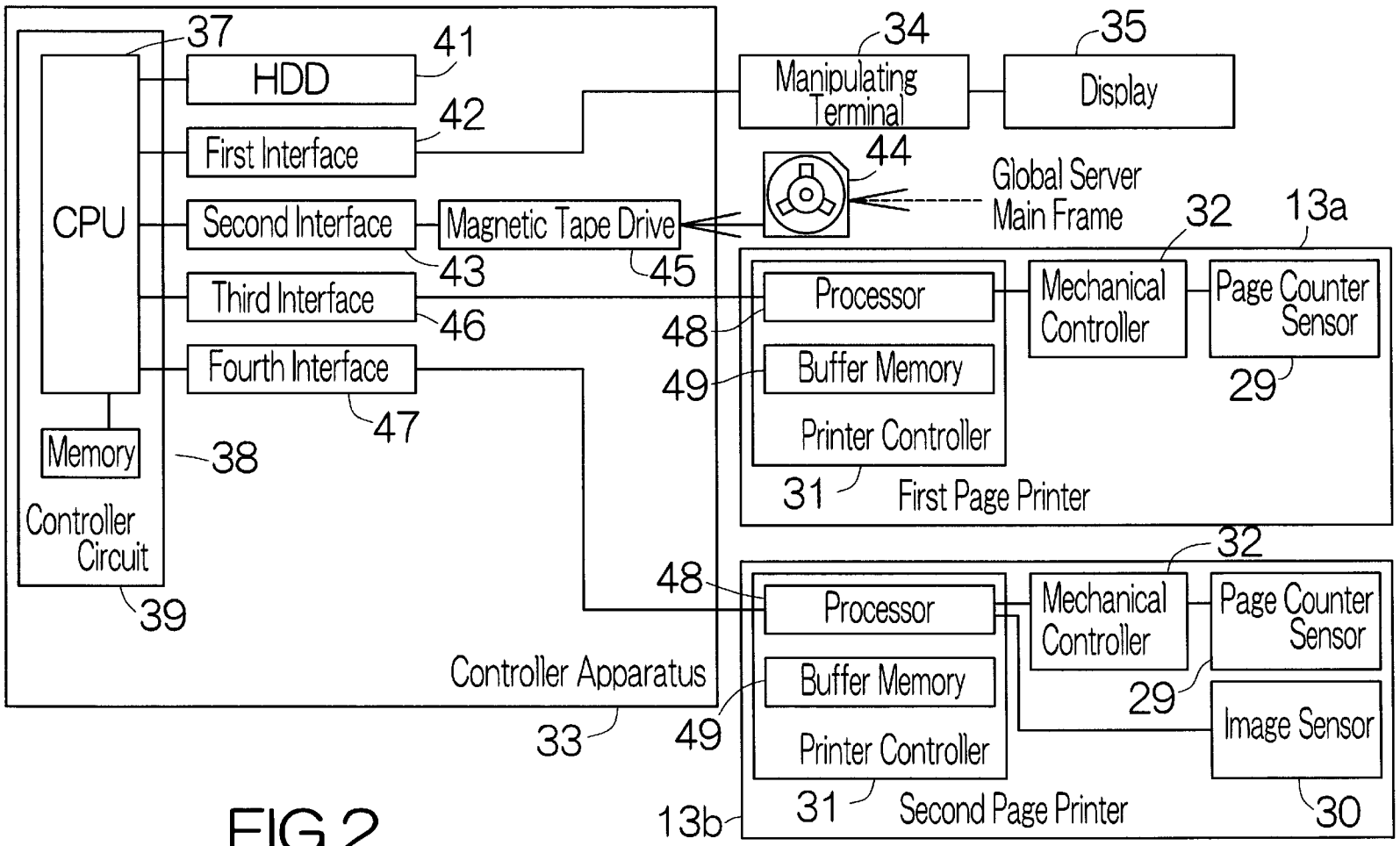
FIG. 2 is a block diagram schematically illustrating a controller system established in first and second page printers and a controller apparatus.

As shown in FIG. 2, the controller apparatus 33 includes a controller circuit 39 comprising a central processor unit (CPU) 37 and a memory 38, for example. A storage device such as a hard disk drive (HDD) 41 may be connected to the controller circuit 39. The CPU 37 of the controller circuit 39 is designed to generate printing data based on the implementation of a printing analysis software program stored in the HDD 41. The CPU 37 may utilize working areas in the memory 38 as well as the HDD 41 when generating the printing data.

A first interface 42 is connected to the CPU 37 of the controller circuit 39. The first interface 42 serves to connect the CPU 37 with the manipulating terminal 34. A data path can thus be established between the CPU 37 and the manipulating terminal 34.

A second interface 43 is also connected to the CPU 37. The second interface 43 serves to connect the CPU 37 with a magnetic tape drive 45 which receives a magnetic tape cartridge 44, for example. The magnetic tape drive 45 is designed to read data out of the magnetic tape cartridge 44. The read data may be stored in the HDD 41. Data can be transferred to the magnetic tape cartridge 44 from an upper apparatus such as a global server or a main frame. The CPU 37 reads data out of the HDD 41 when generating the printing data.

Third and fourth interfaces 46, 47 are also connected to the CPU 37. The third and fourth interfaces 46, 47 serve to connect the CPU 37 with the first and second page printers 13*a,* 13*b,* respectively. The printing data generated at the CPU 37 can be supplied to the printer controllers 31, 31 of the first and second page printers 13*a,* 13*b* through the third and fourth interfaces 46, 47, respectively.

The printer controller 31 includes a processor 48 and a buffer memory 49, for example, in the respective first and second page printers 13*a,* 13*b*. The processor 48 is designed to generate bit map data based on the printing data transferred from the CPU 37 of the controller apparatus 33. At the same time, the processor 48 is designed to manage the operation of the mechanical controller 32 in connection with the control for the rotation of the optical photoconductive drum 24 and the operation of the transporting unit 21. The processor 48 may utilize the memory 49 during operation. The mechanical controller 32 receives the output signals from the page counter sensor 29. The processor 48 of the printer controller 31 receives the output signals from the image sensor 30 in the second page printer 13*b*.

Figure 3:
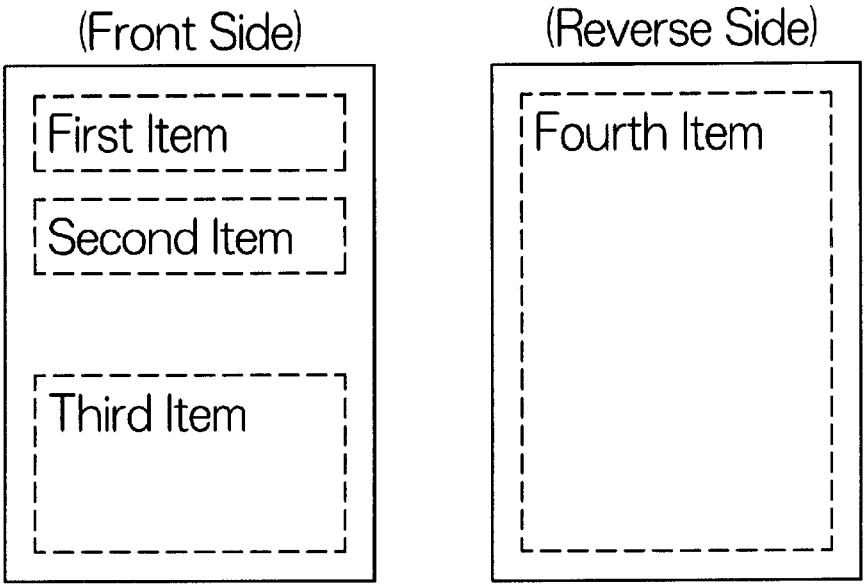
FIG. 3 schematically illustrates a form of a duplex printing finally cut out of continuous forms.

Now, assume that a duplex printing for 10,000 forms or sheets is conducted on the continuous forms 12 in accordance with a predetermined page layout as shown in FIG. 3, for example. A database may be constructed in a global server. Over 100,000 record sets or data sets are managed in this database. The individual data set contains data of first, second, third and fourth items. The forms of the common page layout on the continuous forms 12 can be filled in with the data of the respective data sets. The individual data set generates a single form or sheet of the duplex printing. A layout data for the common page layout can be generated at the global server, for example.

Here, 10,000 data sets and the single layout data are supplied to the controller circuit 39 of the controller apparatus 33. The user interface at the manipulating terminal 34 may be utilized to transfer the data sets and layout data. The CPU 37 of the controller circuit 39 operates to store the data sets and layout data into the HDD 41. The controller apparatus 33 thus sets a printing job based on the received data sets and layout data. Two or more printing jobs may be stored in the HDD 41 at the same time in the controller apparatus 33.

First of all, the continuous forms 12 are set in the first page printer 13*a*. The first page printer 13*a* may implement an automatic loading process so as to set the continuous forms 12. The continuous forms 12 are first inserted into the input slot 16. When a specific press button, not shown, is pushed down, the automatic loading process is started. The mechanical controller 32 activates the transporting unit 21. The transporting unit 21 operates to transport the continuous forms 12 toward the discharge slot 17. When the front end or forefront of the continuous forms 12 reaches a predetermined position, the mechanical controller 32 stops the operation of the transporting unit 21. The automatic loading process may allow the front end of the continuous forms 12 to reach the page counter sensor 29, for example.

Figure 4:
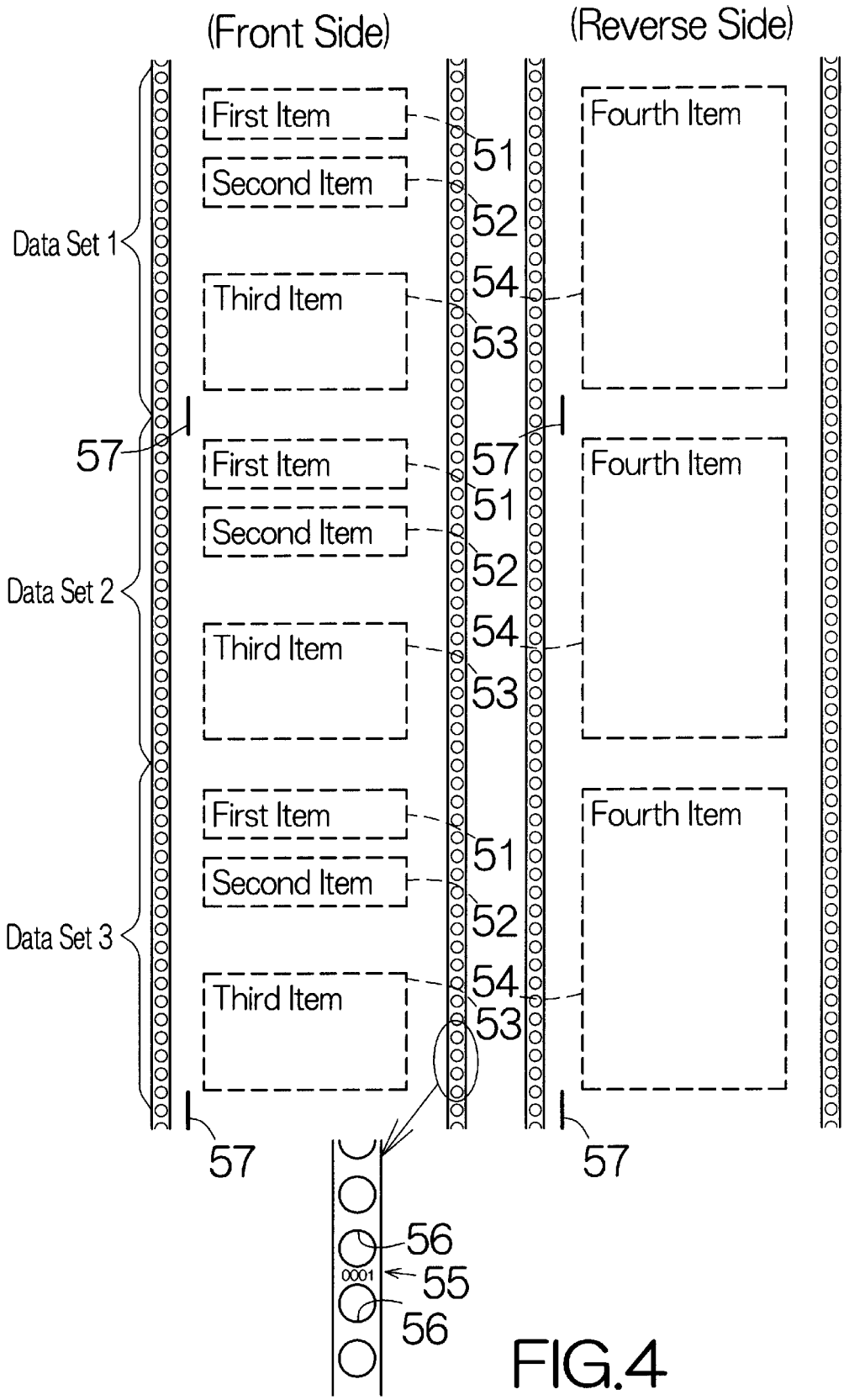
FIG. 4 is a plan view schematically illustrating the continuous forms after the duplex printing.

When the first page printer 13*a* has been prepared for printing in the above-described manner, the operator starts the processing of the printing jobs. The operator may utilize the user interface established at the manipulating terminal 34. The controller circuit 39 of the controller apparatus 33 starts implementing the printing analysis software program in response to the instructions signal from the manipulating terminal 34. The printing analysis software develops the printing job. Specifically, the printing analysis software serves to allocate front side page images and reverse side page images on the continuous forms 12 based on the set page layout, as shown in FIG. 4, for example. The data of first, second and third items are put in predetermined location boxes 51, 52, 53 in the front side page image. The data of fourth item is likewise put in a predetermined location box 54 in the reverse side page image.

Here, the printing analysis software sets a page identification mark 55 in the front side page image, as is apparent from FIG. 4, for example. The page identification mark 55 may be located between adjacent tractor perforations 56, 56 near the edge of the continuous forms 12. The page identification mark 55 is incorporated in the individual front side page images. The page identification mark 55 may take the form of numeral expressing the number of page, alphabetic character, and the like.

Figure 5:
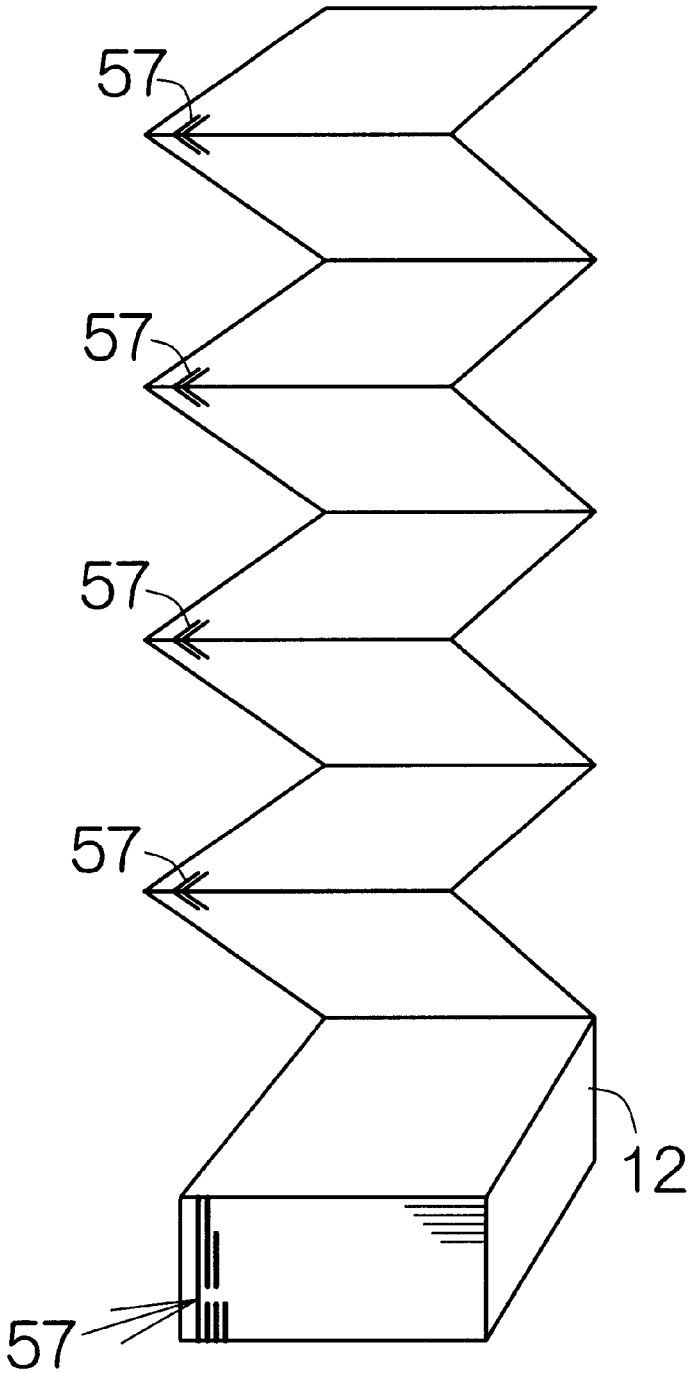
FIG. 5 is a perspective view schematically illustrating line marks on the continuous forms folded into a stack.

Moreover, the printing analysis software sets line marks 57 in at least one of the front and reverse side page image, as shown in FIG. 4, for example. The line marks 57 are located at the fold or the boundary between the page sections on the continuous forms 12 in a conventional manner. As shown in FIG. 5, the line marks 57 can be observed when the continuous forms 12 are folded into a stack. The operator is allowed to distinguish the individual printing jobs from each other based on the line marks 57.

The printing analysis software then sequentially outputs the printing data for the front side page images to the first page printer 13*a*. Likewise, the printing analysis software sequentially outputs the printing data for the reverse side page images to the second page printer 13*b*. When outputting, the printing analysis software notifies the first and second page printers 13*a*, 13*b* of job names. The job names can be utilized to distinguish the individual printing job from each other at the first and second page printers 13*a*, 13*b*.

The first and second page printers 13*a*, 13*b* respectively receive the printing data under the job name. The processor 48 of the first page printer 13*a* then generates bit map data of the front side page images based on the supplied printing data specifying the front side page images. The generated bit map data is utilized to control the mechanical controller 32 in the first page printer 13*a*. In the same manner, the processor 48 of the second page printer 13*b* generates bit map data of the reverse side page images based on the supplied printing data specifying the reverse side page images. The generated bit map data is utilized to control the mechanical controller 32 in the second page printer 13*b*. The bit map data before printing can temporarily be stored in the buffer memory 49.

The first page printer 13*a* first starts the printing operation. The first page printer 13*a* prints the front side page images, the page identification marks 55 and the line marks 57 on the front surface of the continuous forms 12 based on the bit map data. The bit map data for the printed front side page images is temporarily stored in the buffer memory 49, as described later. The mechanical controller 32 is allowed to determine the last printed page on the continuous forms 12 at the first page printer 13*a* with the assistance of the page counter sensor 29. The mechanical controller 32 updates the last printed page every time the individual front side page image has been printed on the continuous forms 12. The number of page for the last printed page may temporarily be stored in the buffer memory 49.

The tandem printers system 11 is designed to reserve the continuous forms 12, corresponding to a predetermined number of forms or page sections, between the page counter sensor 29 of the first page printer 13*a* and the page counter sensor 29 of the second page printer 13*b*. When the first page printer 13*a* has finished the printing operation for establishing the front side page images for the predetermined number of forms or page sections, the first page printer 13*a* stops the printing operation. The continuous forms 12 discharged from the discharge slot 17 of the first page printer 13*a* is then set in the intermediate buffer device 14 and the reversing mechanism device 15.

Thereafter, the continuous forms 12 are set in the second page printer 13*b*. The second page printer 13*b* may implement an automatic loading process so as to set the continuous forms 12, in the same manner as the first page printer 13*a*. The transporting unit 21 serves to transport the continuous forms 12 from the input slot 18 toward the discharge slot 19 in the second page printer 13*b*. When the front end of the continuous forms 12 reaches a predetermined position, the mechanical controller 32 stops the operation of the transporting unit 21. The automatic loading process may allow the front end of the continuous forms 12 to reach the page counter sensor 29, for example.

When the second page printer 13*b* has been prepared for printing in the above-described manner, the operator restarts the processing of the printing job. The first page printer 13*a* is allowed to return to the printing operation for establishing the front side page images corresponding to the page subsequent to the last printed page before the discontinuance of the printing operation. Thereafter, the first page printer 13*a* continues the printing operation at a higher speed.

The image sensor 30 in the second page printer 13*b* serves to detect the first front side page image established on the continuous forms 12. When the first front side page image has been detected, the printer controller 31 starts the printing operation in the second page printer 13*b*. The second page printer 13*b* prints the reverse side page images and the line marks 57 on the reverse surface of the continuous forms 12 based on the bit map data. The reverse side page image for the data of the fourth item is positioned right behind the front side page image of the data set to which the data of the fourth item belongs. The forms or sheets of the duplex printing are thus sequentially formed on the continuous forms 12. The bit map data for the printed reverse side page images is temporarily stored in the buffer memory 49. The mechanical controller 32 is allowed to determine the last printed page on the continuous forms 12 at the second page printer 13*b* with the assistance of the page counter sensor 29. The mechanical controller 32 updates the last printed page every time the individual reverse side page image has been printed on the continuous forms 12. The number of page for the last printed page may temporarily be stored in the buffer memory 49. Thereafter, the second page printer 13*b* continues the printing operation at a higher speed.

Figure 6:
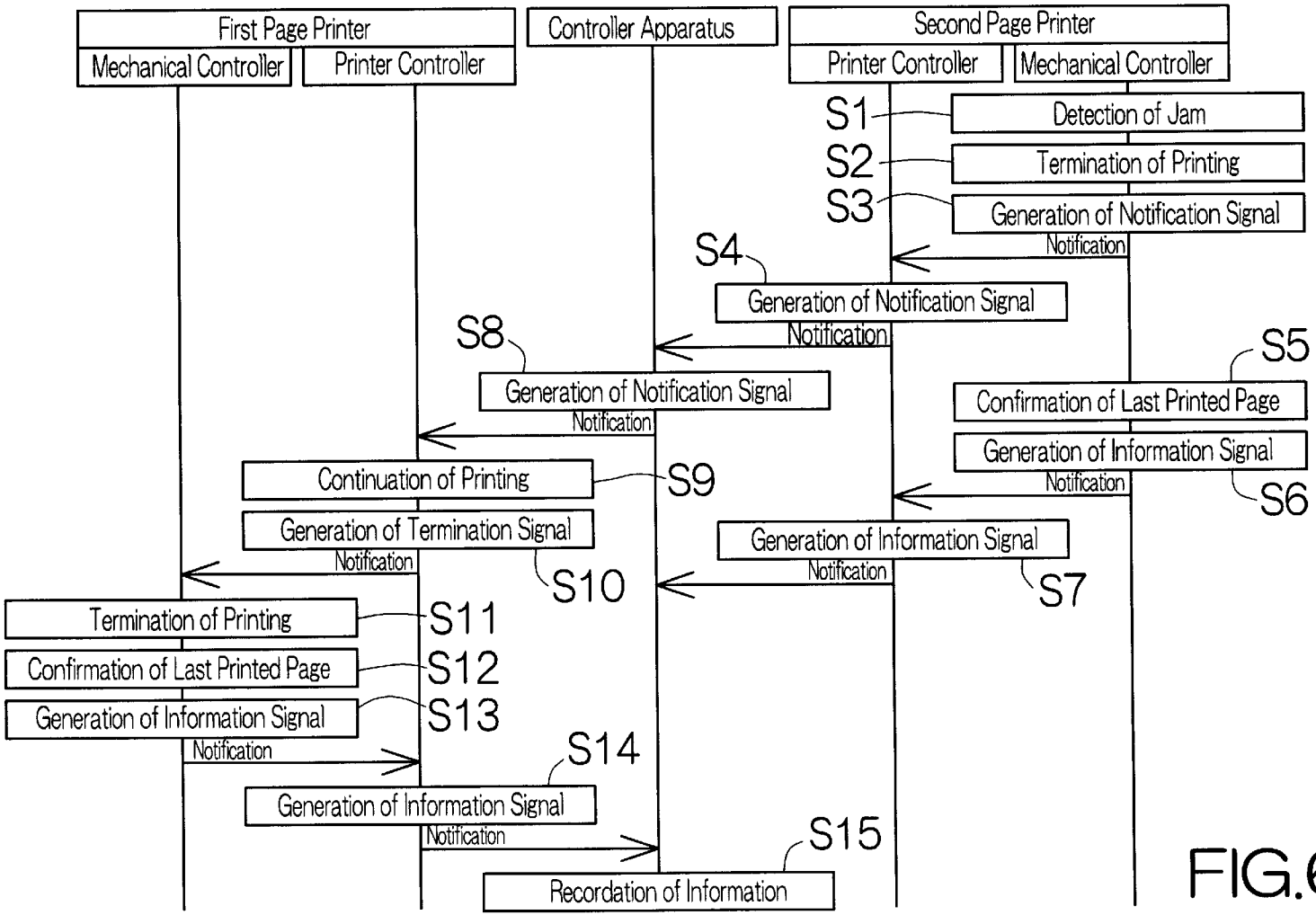
FIG. 6 is a flowchart schematically illustrating the operation of the first and second page printers and the controller apparatus when a jam happens at the second page printer.

Next, assume that a jam takes place at the second page printer 13*b*. As shown in FIG. 6, the mechanical controller 32 first detects the jam in the second page printer 13*a* at step S1. The mechanical controller 32 stops the printing operation of the second page printer 13*b* at step S2. The mechanical controller 32 then notifies the printer controller 31 in the second page printer 13*b* of the fact that the printing operation has been terminated at step S3. The printer controller 31 of the second page printer 13*b* informs the controller apparatus 33 of the termination of the printing operation in the second page printer 13*b* at step S4.

At the same time, the mechanical controller 32 of the second page printer 13*b* confirms the last printed page of the second page printer 13*b* based on the detection of the page counter sensor 29 at step S5. The mechanical controller 32 then notifies the printer controller 31 of the confirmed last printed page at step S6. The printer controller 31 of the second page printer 13*b* in turn notifies the controller apparatus 33 of the last printed page of the second page printer 13*b* along with the job name at step S7.

When the controller apparatus 33 has received the notification signal specifying the termination of the printing operation in the second page printer 13*b*, the controller apparatus 33 notifies the first page printer 13*a* of the termination of the printing operation in the second page printer 13*b* at step S8. The printer controller 31 of the first page printer 13*a* still continues the printing operation for the front side page images corresponding to a predetermined forms or page sections, at step S9, after receiving the notification signal specifying the termination of the printing operation in the second page printer 13*b*. When the printing operation has been completed for the predetermined number of forms or page sections in the first page printer 13*a*, the printer controller 31 instructs the mechanical controller 32 to stop the printing operation at step S10. The mechanical controller 32 thus terminates the printing operation of the first page printer 13*a* at step S11. The mechanical controller 32 of the first page printer 13*a* notifies the printer controller 31 of the last printed page of the first page printer 13*a* based on the detection of the page counter sensor 29 at steps S12, S13. The printer controller 31 of the first page printer 13*a* in turn notifies the controller apparatus 33 of the last printed page of the first page printer 13*a* along with the job name at step S14.

The controller circuit 39 of the controller apparatus 33 stores the information of the job names and the last printed pages, received from the first and second page printers 13*a*, 13*b*, into the HDD 41 at step S15. At the same time, the controller apparatus 33 notifies the manipulating terminal 34 of the jam in the second page printer 13*b*. The user interface serves to display the notification specifying the jam in the second page printer 13*b* on the screen of the display 35 in the manipulating terminal 34. The operator may first pick up the continuous forms 12 after the duplex printing out of the discharge slot 19 of the second page printer 13*b*. The operator then cut off the page sections, damaged under the jam, from the continuous forms 12. The damaged one of the page sections may include the continuous forms 12 on which the toner is held without being fused. In this manner, at least one of the page sections is removed from the continuous forms 12 before establishment of the reverse side page images.

Here, some page sections with the printed front side page images may remain on the continuous forms 12 between the first and second page printers 13*a*, 13*b* even after the damaged one of the page sections has been removed. The continuous forms 12 with the, printed front side page images is set in the second page printer 13*b*. The second page printer 13*b* may implement an automatic loading process so as to properly set the continuous forms 12 in the aforementioned manner. When the front end of the continuous forms 12 reaches the predetermined position, the mechanical controller 32 stops the feed of the continuous forms 12. Since the first page printer 13*a* keeps printing the front side page images corresponding to a predetermined number of forms or page sections even after the jam has happened in the second page printer 13*b* in the aforementioned manner, the intermediate buffer apparatus 14 is allowed to reserve the continuous forms 12 enough even when the automatic loading process is executed in the second page printer 13*b* in this manner.

When the feed of the continuous forms 12 has been terminated in the second page printer 13*b*, the image sensor 30 serves to detect the page identification mark 55 on the continuous forms 12 in the second page printer 13*b*. The printer controller 31 of the second page printer 13*b* serves to select one of the printed pages, namely, the printed front side page images based on the detected page identification mark 55. The printer controller 31 then finds out the reverse side page image corresponding to the selected one of the printed front side page image. The first recovery page can be determined in the second page printer 13*b* in this manner. The first recovery page of the second page printer 13*b* can be determined based on the selected one of the printed front side page images established at the first page printer 13*a*.

Figure 7:
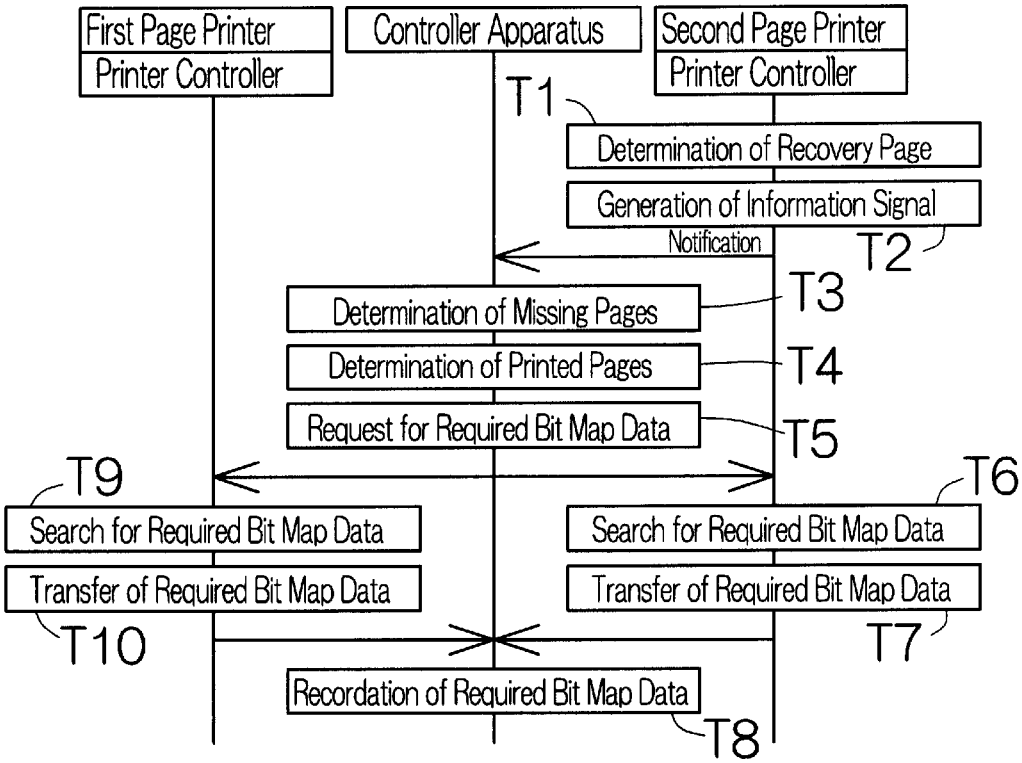
FIG. 7 is a flowchart schematically illustrating the operation of generating backup data when the jam happens at the second page printer.

As shown in FIG. 7, when the first recovery page for the second page printer 13*b* has been determined at step T1, the printer controller 31 of the second page printer 13*b* notifies the controller apparatus 33 of the determined first recovery page at step T2. The controller circuit 39 of the controller apparatus 33 then determines, at step T3, missing pages of the second page printer 13*b* based on the first recovery page determined at the second page printer 13*b* and the last printed page for the second page printer 13*b* stored in the HDD 41. The missing pages can be specified by the job name of the printing job to which the missing pages belong to and the number of page or place in the printing job. When the missing pages of the second page printer 13*b* have been determined in this manner, the controller circuit 39 of the controller apparatus 33 then determines the printed pages, namely, the printed front side page images at the first page printer 13*a* related to the missing pages of the second page printer 13*b* at step T4. The printed pages may be specified by the job name of the printing job to which the printed pages belong to and the number of page or place in the printing job.

The controller circuit 39 of the controller apparatus 33 thereafter instructs the second page printer 13*b* to provide with backup data at step T5. The backup data comprises the bit map data for the reverse side page images corresponding to the missing pages. The printer controller 31 searches the required bit map data in the bit map data temporarily stored in the buffer memory 49 in the second page printer 13*b* at step T6. The required bit map data is transferred to the controller apparatus 33 from the printer controller 31 of the second page printer 13*b* at step T7. The required bit map data is then stored in the HDD 41, for example, as the backup data in the controller apparatus 33 at step T8.

At the same time, the controller circuit 39 of the controller apparatus 33 instructs the first page printer 13*a* to provide with backup data at step T5. The backup data comprises the bit map data for the front side page images corresponding to the printed pages of the first page printer 13*a*. The printed pages of the first page printer 13*a* are respectively related to the missing pages of the second page printer 13*b* in the aforementioned manner. The printer controller 31 searches the required bit map data in the bit map data temporarily stored in the buffer memory 49 in the first page printer 13*a* at step T9. The required bit map data is transferred to the controller apparatus 33 from the printer controller 31 of the first page printer 13*a* at step T10. The required bit map data is then stored in the HDD 41, for example, as the backup data in the controller apparatus 33 at step T8.

The bit map data related to the printed pages is temporarily stored in the buffer memory 49 in the printer controller 31 in the first page printer 13*a* as described above. The extend of the printed pages can be determined based on the number of forms or page sections on the continuous forms 12 reserved between the page counter sensor 29 of the first page printer 13*a* and the page counter sensor 29 of the second page printer 13*b*, for example. The bit map data related to the front side page images is reliably kept in the buffer memory 49 in the first page printer 13*a* as long as the corresponding reverse side page images are printed on the reverse surface of the continuous forms 12 after establishment of the front side page images on the continuous forms 12.

When the first and second page printers 13*a*, 13*b* have been prepared in the above-described manner, the operator then restarts the printing operation of the printing job. The operator may operate the manipulating terminal 34, for example. The controller apparatus 33 instructs the second page printer 13*b* to restart the printing operation. The printer controller 31 of the second page printer 13*b* operates to restart the printing operation from the reverse side page image corresponding to the first recovery page of the second page printer 13*b*. Since the first recovery page is selected from the printed pages established at the first page printer 13*a*, the printing operation of the second page printer 13*b* as described above serves to minimize the loss of the continuous forms 12 reserved between the first and second page printers 13*a*, 13*b*. The second page printer 13*b* is then allowed to continue the printing operation at a higher speed.

The controller circuit 39 of the controller apparatus 33 thereafter instructs the first page printer 13*a* to restart the printing operation only when the continuous forms 12, corresponding to the predetermined number of forms or page sections, has been reserved between the first and second page printers 13*a*, 13*b*. The printer controller 31 determines the first recovery page based on the last printed page before the termination of the printing operation in the first page printer 13*a*. The first recovery page is the page subsequent to the last printed page of the first page printer 13*a*. The first page printer 13*a* restarts the printing operation for the front side page image corresponding to the first recovery page. The series of the front side page images are printed in a predetermined sequence, without any change or skip, on the continuous forms 12 discharged from the discharge slot 17 of the first page printer 13*a*. The first page printer 13*a* is then allowed to continue the printing operation at a higher speed.

Now, assume that the continuous forms 12 corresponding to twenty (20) page sections are reserved between the last printed page of the first page printer 13*a* and the last printed page of the second page printer 13*b*. When the second page printer 13*b* is printing the fifteenth (15th) reverse side page image on the continuous forms 12, the first page printer 13*a* is printing the thirty-fifth (35th) front side page image on the continuous forms 12. If a jam at the second page printer 13*b* requires removal of the continuous forms 12 corresponding to three (3) page sections, the eighteenth (18th) and subsequent front side page images still remain on the front surface of the continuous forms 12 between the first and second page printers 13*a*, 13*b*. When the continuous forms 12 with the eighteenth (18th) and subsequent front side page images are set in the second page printer 13*b*, it is possible to restart the printing operation from the reverse side page image related to the twenty-first (21st) front side page image, for example, in the second page printer 13*b*. In this case, the continuous forms 12 corresponding to the eighteenth (18th) to twentieth (20th) front side page images are forced to pass the imaging unit 24 in the second page printer 13*b* based on the aforementioned automatic loading process. On the other hand, the continuous forms 12 along with the fifteenth (15th) to thirty-fifth (35th) front side page images are simply removed and destroyed in a conventional tandem printers system.

Here, the bit map data corresponding to the missing pages of the second page printer 13*a*, namely, the fifteenth (15th) to twentieth (20th) reverse side page images, is stored in the HDD 41. At the same time, the bit map data corresponding to the printed pages, related to the missing pages of the second page printer 13*b*, of the first page printer 13*a*, namely, the fifteenth (15th) to twentieth (20th) front side page images, is stored in the HDD 41.

At the recovery of the printing operation at the first and second page printers 13*a*, 13*b*, the controller circuit 39 of the controller apparatus 33 accesses the HDD 41 so as to read the backup data for the first page printer 13*a*. The controller circuit 39 set an additional or auxiliary printing job for the first page printer 13*a* based on the backup data. Likewise, the controller circuit 39 accesses the HDD 41 so as to read the backup data for the second page printer 13*b*. An additional or auxiliary printing job is also set for the second page printer 13*b* based on the backup data. When the settings have been completed, the controller circuit 39 schedules the additional printing jobs of the first and second page printers 13*a*, 13*b* after the printing job in progress in the first page printer 13*a*. The printing job in progress in the first page printer 13*a* may be determined based on the last printed page, related to the first page printer 13*a*, recorded in the HDD 41 when the jam happens.

When the printing job has thereafter been finished in the first page printer 13*a*, the backup data for the first page printer 13*a* is supplied to the printer controller 31 of the first page printer 13*a* based on the scheduled additional printing job. The printer controller 31 of the first page printer 13*a* receives the bit map data included in the backup data. The first page printer 13*a* prints the front side page images on the front surface of the continuous forms 12 based on the supplied bit map data. The first page printer 13*a* is in this manner allowed to again print the front side page images removed from the continuous forms 12 when the jam happens.

Subsequently, when the printing job has been finished in the second page printer 13*b,* the backup data for the second page printer 13*b* is supplied to the printer controller 31 of the second page printer 13*b* based on the scheduled additional printing job. The printer controller 31 of the second page printer 13*b* receives the bit map data included in the backup data. The second page printer 13*b* prints the reverse side page images on the reverse surface of the continuous forms 12 based on the supplied bit map data. The second page printer 13*b* is in this manner allowed to print the reverse side page images on the reverse surface of the continuous forms 12 just behind the front side page images removed from the continuous forms 12 when the jam happens.

For example, in the case where the printing job completed at the first page printer 13*a* has no correspondence with the printing job subsequently completed at the second page printer 13*b,* the second page printer 13*b* may execute the printing job in accordance with the schedule previously set in the controller apparatus 33. Here, the execution of the additional printing job is deferred. In this manner, the schedule of the printing jobs, including any additional printing jobs, for the second page printer 13*b* always coincides with the schedule of the printing jobs, including any additional printing jobs, for the first page printer 13*a*. The expected duplex printing is thus reliably realized on the continuous forms 12.

When the first and second page printers 13*a,* 13*b* return to the printing operation in the above-described manner, the continuous forms 12 corresponding to a predetermined number of forms or page sections are reserved between the first and second page printers 13*a,* 13*b*. Here, a sag sensor 61 located in the intermediate buffer device 14 may be employed to adjust the length of the continuous forms 12 between the first and second page printers 13*a,* 13*b,* as is apparent from FIG. 1, for example. The sag sensor 61 detects the degree or amount of sag of the continuous forms 12 stored in the intermediate buffer device 14. When the excessive continuous forms 12 are stored in the intermediate buffer device 14, the sag sensor 61 outputs a signal warning the excessive reserve. Based on the output signal, the reserve of the continuous forms 12 corresponding to page sections over the predetermined number can be determined.

In the case where the sag sensor 61 is employed, the first page printer 13*a* is set to continue printing the front side page images on the continuous forms 12, corresponding to the number of forms or page sections completely extending between the hopper 22 and the page counter sensor 29 in the second page printer 13*b,* before termination of the printing operation. If the removed part of the continuous forms 12 is shorter than the distance between the hopper 22 and the page counter sensor 29, the continuous forms 12 of the excessive amount is expected to stay in the intermediate buffer device 14 after the continuous forms 12 have properly been set in the second page printer 13*b*. In this case, the controller apparatus 33 first restart the printing operation at the second page printer 13*b,* while deferring the recovery of the printing operation at the first page printer 13*a*. When the excessive sag has been relieved in the intermediate buffer device 14, the controller apparatus 33 restarts the printing operation at the first page printer 13*a* based on the output signal from the sag sensor 61. In this manner, the continuous forms 12 corresponding to the predetermined number of forms or page sections can always be reserved in the intermediate buffer device 14.

Figure 8:
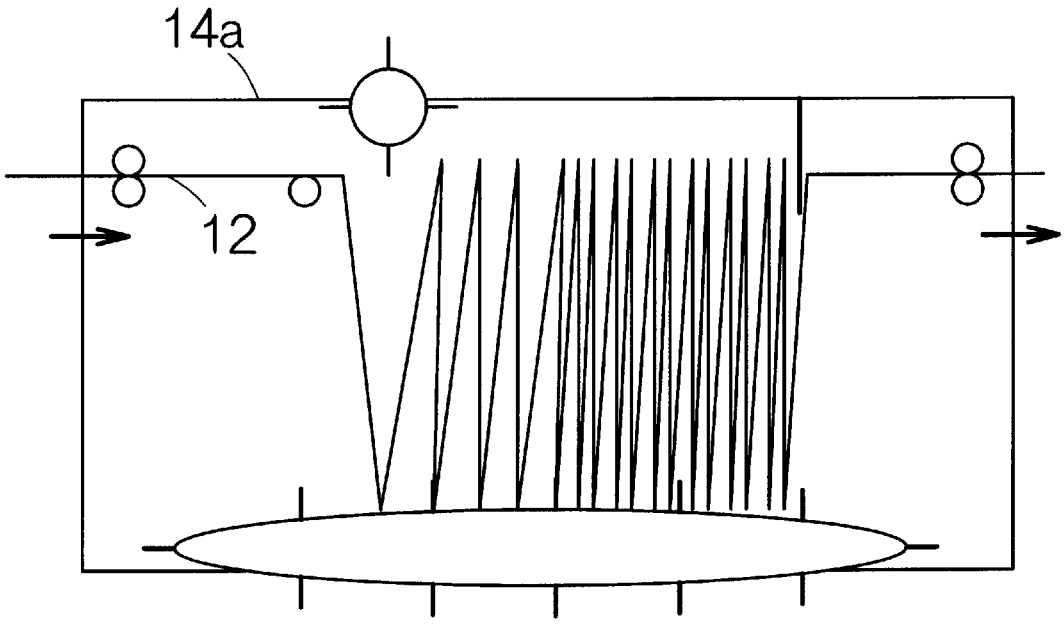
FIG. 8 is a side view schematically illustrating another example of an intermediate buffer device.
Figure 9:
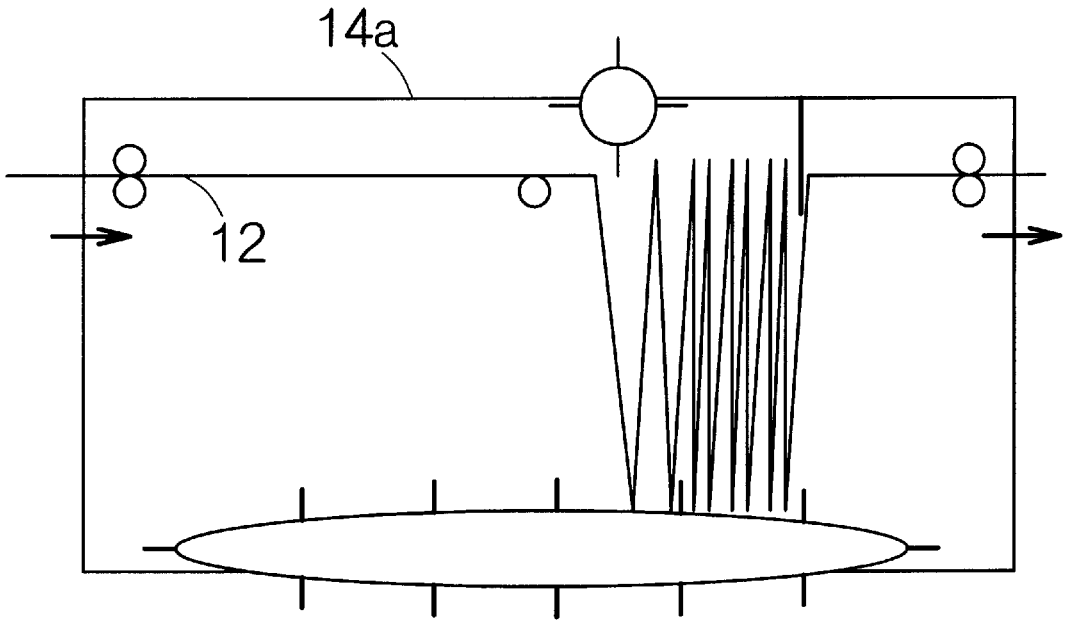
FIG. 9 is a side view schematically illustrating the action of the intermediate buffer device.

Otherwise, when the continuous forms 12 corresponding to the greater number of forms or page sections can be kept in the intermediate buffer device 14*a,* as shown in FIG. 8, the printing operation can simultaneously be terminated at both the first and second page printers 13*a,* 13*b* upon occurrence of a jam at the second page printer 13*b*. In this case, when the continuous forms 12 is set in the second page printer 13*b* for the recovery of the printing operation, the automatic loading process at the second page printer 13*b* induces reduction in the amount of the continuous forms 12 in the intermediate buffer device 14*a,* as shown in FIG. 9. The controller apparatus 33 then restarts the printing operation at the first page printer 13*a* alone. When the continuous forms 12 corresponding to the predetermined number of forms or page sections have been reserved in the intermediate buffer device 14*a,* the controller apparatus 33 restarts the printing operation at the second page printer 13*b*. In this manner, the continuous forms 12 corresponding to the predetermined number of forms or page sections can always be reserved in the intermediate buffer device 14*a*.

Figure 10:
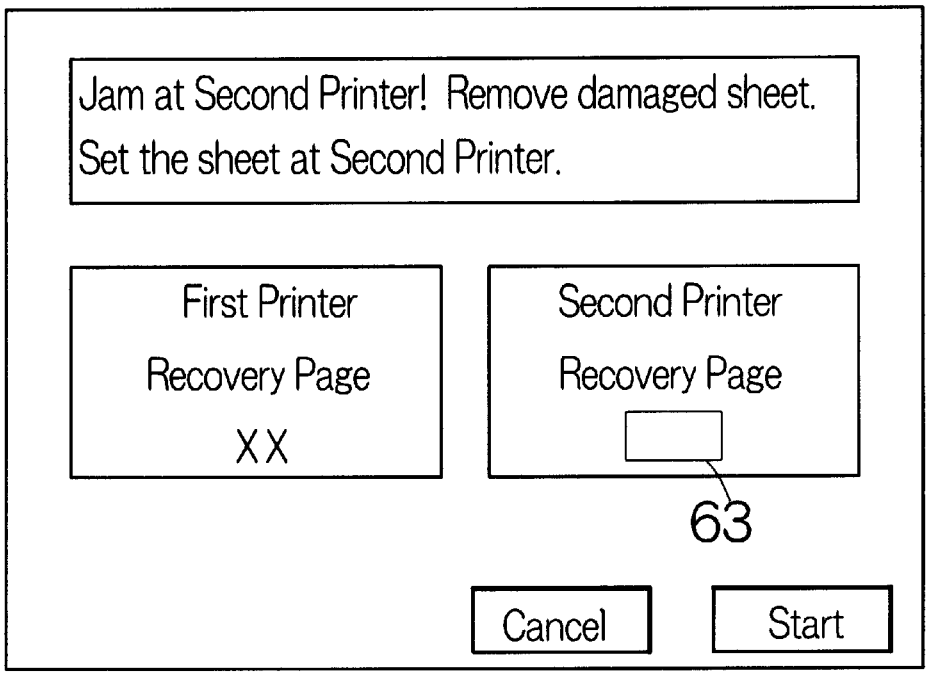
FIG. 10 is a plan view illustrating text and graphics of a specific example displayed on the screen of a display in a manipulating terminal when a jam happens at the second page printer.

In the aforementioned tandem printers system 11, the manipulation by the operator may be employed to determine the first recovery page of the second page printer 13*b* when a jam happens at the second page printer 13*b*. Here, text and graphics may be displayed on the screen of the display 34 in the manipulating terminal 34, as shown in FIG. 10, for example, so as to allow the operator to input the information of the first recovery page. The operator should read the page identification mark 55 on the front-end page section after removal of the continuous forms 12 corresponding to the damaged ones of the page sections. An input box 63 of the graphics on the screen may be filled in with the information on the read page identification mark 55. The operator may utilize the operation of the keyboard or mouse in the manipulating terminal 34. The controller circuit 39 of the controller apparatus 33 is thus allowed to note the first page sections or first front side page image on the continuous forms 12.

After reading the page identification mark 55, the operator sets the continuous forms 12 at the hopper 22 in the second page printer 13*b*. The automatic loading process causes the feed of the continuous forms 12 in the second page printer 13*b*. As described above, when the front end or forefront of the continuous forms 12 reaches the predetermined position, the mechanical controller 32 stops the feed of the continuous forms 12. The printer controller 31 monitors the feed amount of the continuous forms 12 in the second page printer 13*b*. The controller circuit 39 of the controller apparatus 33 determines the first recovery page of the second page printer 13*b* based on the information of the page identification mark 55 input to the manipulating terminal 34 and the feed amount detected in the second page printer 13*b*.

The tandem printers system 11 of the above-described type may be employed to realize a so-called spot color printing. In this case, the reversing mechanism device 15 is removed between the first and second page printers 13*a,* 13*b*. The first page printer 13*a* may be designed to print monochrome page images on the front surface of the continuous forms 12 while the second page printer 13*b* may be designed to print color page images, such as red or blue page images, on the front surface of the continuous forms 12.

Any type of data or image data, other than the aforementioned bit map data, may be employed to record the reverse side page image corresponding to the missing page for the second page printer 13*b,* the front side page image related to the missing page, and the like, into the HDD 41. In the tandem printers system 11, the printer controller 31 of the first page printer 13*a,* or the printer controller 31 of the second page printer 13*b,* independently or in combination, may take the operation of the controller circuit 39.

What is claimed is:

1. A tandem printers system comprising:

a first printer printing primary page images on a continuous sheet;

a second printer printing secondary page images, related to the primary page images, on page sections regulated by the primary page images on the continuous sheet; and a controller determining a first recovery page for the second printer based on a printed page at the first printer when at least one of the page sections is removed from the continuous sheet before establishment of the secondary page images.

2. The tandem printers system according to claim 1, wherein said controller determines a missing page for the second printer based on the first recovery page and a last printed page at the second printer.

3. The tandem printers system according to claim 2, further comprising a storage medium storing a printing data of the secondary page image corresponding to the missing page.

4. The tandem printers system according to claim 3, wherein said storage medium further stores a printing data of the primary page image related to the missing page for the second printer.

5. The tandem printers system according to claim 1, wherein said controller determines a first recovery page for the first printer based on a last printed page for the first printer.

6. The tandem printers system according to claim 5, wherein said first printer continues printing the primary page image for a predetermined number of page when a jam happens at the second printer.

7. A tandem printers system comprising:

a first printer printing primary page images on a continuous sheet;

a second printer printing secondary page images, related to the primary page images, on page sections regulated by the primary page images on the continuous sheet; and a controller determining a first recovery page for the first printer based on a last printed page at the first printer when a jam happens at the second printer.

8. The tandem printers system according to claim 7, further comprising a storage medium storing a printing data of the primary page image for a missing page determined based on a last printed page and a first recovery page for the second printer.

* * * * *